US005594986A

United States Patent [19]

Frenkel et al.

[11] Patent Number: 5,594,986

[45] Date of Patent: Jan. 21, 1997

[54] METHOD FOR OBTAINING AN ELECTRICAL CONNECTION WITH A THIN MONOFACE CONDUCTIVE STRIP AND CONNECTION THUS OBTAINED

[75] Inventors: Erik J. Frenkel, Neuchâtel; Jean-Jacques Born, Morges, both of France

[73] Assignee: Asulab S.A., Bienne, Switzerland

[21] Appl. No.: 305,063

[22] Filed: Sep. 13, 1994

[30] Foreign Application Priority Data

Sep. 21, 1993 [FR] France ..... 93 11315

[51] Int. Cl.[6] ..... H01R 43/04

[52] U.S. Cl. ..... 29/861; 29/829; 156/45; 264/296; 264/322

[58] Field of Search ..... 29/861, 825, 829; 156/45, 50; 264/296, 322, 339

[56] References Cited

U.S. PATENT DOCUMENTS 3,032,739 5/1962 Tuchel .
4,266,339 5/1981 Kalt ..... 29/829
4,870,969 10/1989 Swartz ..... 128/419
5,131,854 7/1992 Jose et al. ..... 439/86

*Primary Examiner*—Carl J. Arbes
*Attorney, Agent, or Firm*—Griffin, Butler, Whisenhunt & Kurtossy

[57] ABSTRACT

Method of manufacturing an electrical connection, and connection thus obtained between a strip of a plastic material (1) having a conductive coating on a single face (5) and a second conductor (15) positioned on the non-conductive side (3) of said strip consisting of forming into a loop the lug (7), formed by the end portion of said strip, by thermoforming between two parallel cylinders of which at least one is heated, driven in rotation to come to press the non-conductive face of the lug (7) against a non-conductive portion of the strip.

7 Claims, 1 Drawing Sheet

Figure 1:
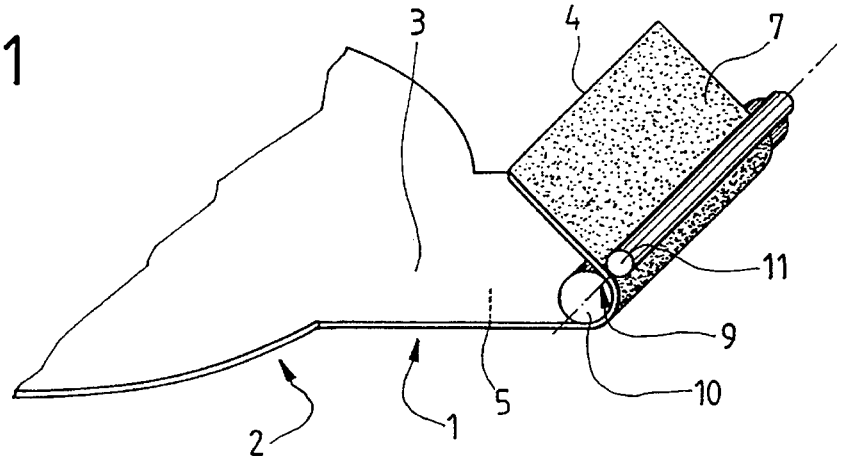

METHOD FOR OBTAINING AN ELECTRICAL CONNECTION WITH A THIN MONOFACE CONDUCTIVE STRIP AND CONNECTION THUS OBTAINED

The present invention generally concerns a method enabling an electrical connection to be achieved between a thin plastic monoface conductive strip and a second conductor positioned on the non-conductive side of the strip. The invention also concerns the connection thus obtained.

The invention concerns more particularly a method enabling such an electrical connection to be established when the contact with a second conductor needs to be achieved, by reason of the particular configuration of the device incorporating said connection, simply by pressing upon a portion of the thin plastic strip, on the side of its non-conductive face. An electrical connection according to the invention is for example obtained with a second conductor formed by a metallic elastic strip.

Thin plastic monoface conductive strips are used more and more in devices with a short lifespan, both as such and as an end portion intended to ensure an electrical contact with a thin plastic conductive film of a larger surface area but of the same nature. These strips or films have certain advantages, notably at the level of cost price, in comparison with metallic conductors of the same size. By an appropriate choice of plastic material, it is possible to obtain a supporting base exhibiting mechanical resistance, and in particular rigidity and satisfactory flexibility whilst having a very small thickness. By using a polyamide film (for example Capra® available from Allied Chemical) or polyethylene terephthalate, PET (for example Hostaphon® available from Hoechst) one can have strips of a thickness in the order of 0.1 to 0.2 mm whilst having a rigidity approaching that of a metal strip of the same thickness. The application of the conductive coating may be achieved according to known methods, such as serigraphy or cathodic sputtering, and enables conductive layers of the order of a micron to be obtained. It is thus possible to use precious metals such as gold, silver, platinum or palladium as the conductive material, without this notably affecting the final cost price. This choice of precious metal may be made necessary by the particular function of larger surface area film, extendedby the strip used to establish a connection. This is the case for example when the larger surface area film constitutes an electrode intended to come into contact with the skin, for example in a device for the transdermic administration of drugs by iontophoresis or electrophoresis. However, despite the above cited advantages and taking account precisely of the very small thickness of the conductive layer, such thin plastic monoface conductive strips or films ill lend themselves to pronounced mechanical distortions, such as bending at a sharp angle, without running the risk of damaging the conductive coating.

The present invention thus concerns a method enabling a thin plastic strip, having a conductive coating on a single face to establish a contact area on the side not having a conductive coating, to be deformed without risk of rupturing the conductive layer.

To this end, the thin plastic monoface conductive strip is selected in a material which is able to be thermoformed, such as the materials mentioned above (polyamide or PET), and a loop is formed by folding a lug formed by the end portion of the strip, between two parallel cylinders positioned respectively on the conductive face and the non-conductive face, at least one cylinder being heated, and the two cylinders being driven in rotation until the cylinder resting upon the conductive face comes to be pressed against the non-conductive face of the lug on a non-conductive portion of the strip.

In order to achieve a prestress which will keep the facing non-conductive portions pressed against each other, the cylinder which is applied onto the side of the conductive face of the strip will preferably be chosen with a diameter inferior to that of the cylinder applied onto the side of the non-conductive face. In this embodiment of the method, it is possible to heat only the cylinder situated on the side of the non-conductive face thereby having the advantage of placing the conductive coating in contact only with a wall at substantially room temperature, which reduces the risk of deterioration of said conductive coating by migration of the plastic layer to the surface of the conductive coating. In order to achieve this rolling operation, the cylinder applied onto the side of the non-conductive face is held in a fixed position, whilst the second cylinder is rolled onto the first until it comes to press the two non-conductive portions of the strip against each other: the displacement of the folding line on the surface of the conductive coating avoids local overheating and at the same time the eventual deterioration of said coating. It is however possible, as a function of the nature of the plastic supporting coating, the nature of the conductive coating and their respective thicknesses, to keep the folding line fixed and to roll the cylinder situated on the non-conductive face by driving the second cylinder until the two portions of the non-conductive faces come into contact. When the rolling operation is finished, the two cylinders are withdrawn, and the contact thus formed may be used as such in a connection where a second metallic conductor presses upon the conductive portion at the end of the strip. It is also possible to keep the non-conductive portions more firmly pressed against each other by interposing a small quantity of adhesive between said portions.

Figure 2A:
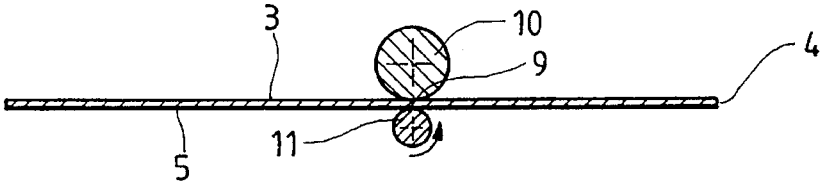
Figure 2B:
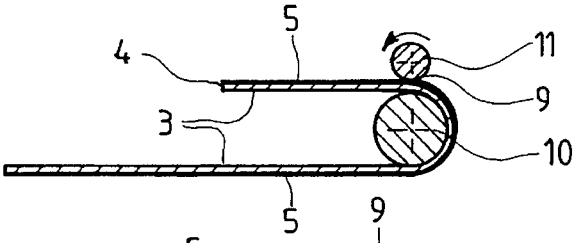
Figure 2C:
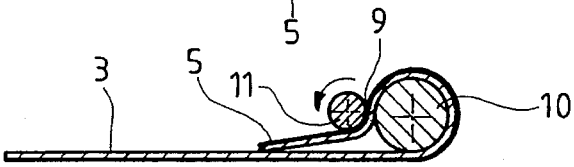
Figure 2D:
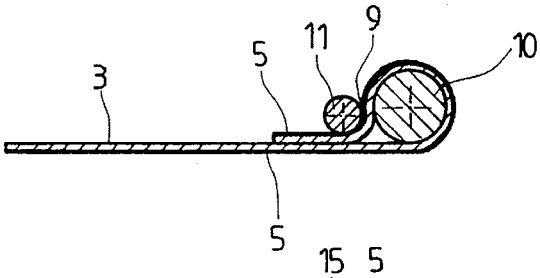
Figure 3:
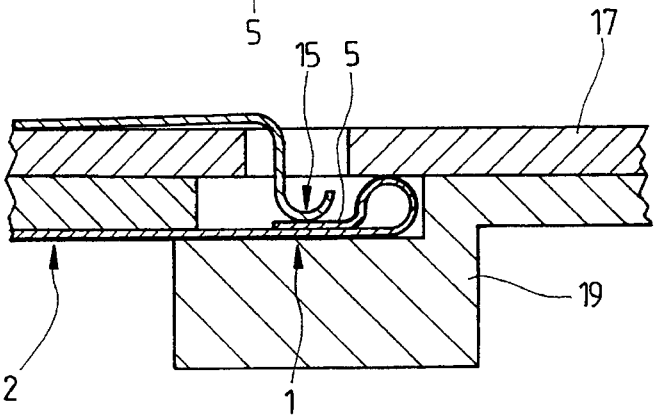

An example of the invention will now be described in detail, with reference to the accompanying drawings, in which:

FIG. 1 shows in perspective a view of an electrical connection at a step of the method according to the invention;

FIGS. 2*a* to 2*d* show schematical views of an electrical connection at successive steps of the method according to the invention, and FIG. 3 shows a cross-sectional view of an example of an electrical connection according to the invention.

As shown in FIG. 1, in an intermediate step of the method, one end of strip 1 formed by the extension of a larger surface 2 is kept folded along a line of contact 9 between two parallel cylinders 10 and 11 positioned respectively on the side of the non-conductive face 3 and the side of the conductive face 5 of strip 1 leaving free a portion of strip forming a lug 7. In the embodiment shown, cylinder 11 which is applied onto conductive face 5 has a diameter less than that of cylinder 10 applied onto non-conductive face 3.

FIGS. 2*a* to 2*d* show schematical views of different steps of the method in which cylinder 11 positioned on conductive face 5 rolls onto cylinder 10. At the beginning of the method, shown in FIG. 2*a*, cylinders 10 and 11 are positioned on the strip in such a way that their contact line 9 is at a distance from the end 4 of lug 7 greater than the circumference of cylinder 10. FIG. 2*b* shows a step of the method in which cylinder 11 has covered half of the circumference of cylinder 10. In FIG. 2*c*, cylinder 11 has covered a quarter of the supplemental circumference and end 4 of the lug is pressing upon non-conductive face 3 of strip 1. In the last step shown in FIG. 2*d*, cylinder 11 completely presses a portion of lug 7 onto strip 1 imprinting on the strip an inflection line along contact line 9, thus creating a prestress after the withdrawal of the two cylinders at the end of the method. In the step of the method shown in FIG. 2*b*, it is also possible to add a small quantity of adhesive onto face 3, close to cylinder 10, in order to keep the two non-conductive face portions more firmly pressed against each other.

According to an alternative embodiment, it is also possible to obtain the preceding result by keeping cylinders 10 and 11 fixed in relation to each other, that is to say by keeping contact line 9 always in the same place on the strip, and by rolling cylinder 10 on the non-conductive face. In such a case, lug 7 can be of an inferior length to that in the preceding example.

FIG. 3 shows a cross-sectional view of an example of the connection obtained between a thin monoface conductive strip formed according to the method of the invention and a conductor formed by an elastic metallic strip 15 in the form of a hook. Metallic strip 15 forms for example a contact of a measuring device contained in a rigid case 17. Strip 1, whose end portion is formed according to the method of the invention, forms for example the contact of an electrode extending said strip 1 by a larger surface area 2, these two parts being cut out of the same plastic monoface conductive film, and being held in a structure 19 by appropriate means to place in contact the end of metallic strip 15 and conductive face 5 of the end portion of lug 7. Structure 19 represents for example the element intended to receive a drug in the device for the transdermic administration by iontophoresis or electrophoresis, said element being intended to be disposed of when the drug reserve is exhausted.

Without departing from the framework of the invention, a man skilled in the art is capable of adapting the method to a particular need, and of applying the connection to a large number of devices, in particular in those where it is necessary to ensure an electrical connection between an expensive element and an element intended to be disposed of, and which is therefore required to be inexpensive.

We claim:

1. A method of manufacturing an electrical connection for connecting a conductive coating disposed on a single face only of a thin strip of material to a second conductor disposed opposite a non-conductive face of said thin strip of material, said method comprising:

providing a thin strip of thermoformable plastic material including an end portion, said thin strip, including said end portion, having a conductive coating on a single face only whereby said thin strip and end portion have a conductive face and a non-conductive face;

placing said end portion between first and second parallel cylinders with the non-conductive face facing toward the second cylinder;

heating at least one of said cylinders; and rolling up a lug by folding said end portion, said folding being carried out by driving said cylinders in rotation until the non-conductive face of said end portion is pressed against the non-conductive face of said thin strip.

2. Method according to claim 1, characterised in that the first cylinder has a diameter less than that of the second cylinder.

3. Method according to claim 1 wherein the second cylinder is kept positioned on the non-conductive face and the first cylinder is rolled on the conductive face to roll up said lug.

4. Method according to claim 1 wherein the first and second cylinders are kept fixed in relation to each other and the second cylinder is rolled on the non-conductive face of the strip by driving the first cylinder.

5. Method according to claim 1 and further comprising the step of adding a small quantity of adhesive between the non-conductive surfaces facing the lug and the strip.

6. Method according to claim 1, characterised in that only the second cylinder is heated.

7. An electrical connection made according to the method set forth in claim 1.

* * * * *

UNITED STATES PATENT AND TRADEMARK OFFICE

CERTIFICATE OF CORRECTION

PATENT NO. : 5,594,986
DATED : January 21, 1997
INVENTOR(S) : Erik J. Frenkel et al.

It is certified that error appears in the above-indentified patent and that said Letters Patent is hereby corrected as shown below:

Title page item [75],

Inventors: Erik J. Frenkel, Neuchatel;
Jean-Jacques Born, Morges, both of
France should read Inventors: Erik J. Frenkel, Neuchatel
Jean-Jacques Born, Morges, both of
Switzerland Signed and Sealed this First Day of April, 1997

*Attest:*

*Attesting Officer*

BRUCE LEHMAN

*Commissioner of Patents and Trademarks*